US005301725A

United States Patent [19]

Meinzinger

[11] Patent Number: 5,301,725

[45] Date of Patent: Apr. 12, 1994

[54] VESSEL TREATING MACHINE

[75] Inventor: Rupert Meinzinger, Kirchrot/Oberzeitldorn, Fed. Rep. of Germany

[73] Assignee: Krones AG Hermann Kronseder Maschinenfabrik, Neutraubling, Fed. Rep. of Germany

[21] Appl. No.: 920,560

[22] PCT Filed: Dec. 20, 1991

[86] PCT No.: PCT/EP91/02469

§ 371 Date: Sep. 16, 1992

§ 102(e) Date: Sep. 16, 1992

[87] PCT Pub. No.: WO92/11197

PCT Pub. Date: Jul. 9, 1992

[30] Foreign Application Priority Data

Dec. 21, 1990 [DE] Fed. Rep. of Germany ..... 9017262

[51] Int. Cl.[5] ..... B67C 3/00; B65B 1/04; B65B 3/00

[52] U.S. Cl. ..... 141/372; 141/378; 141/312

[58] Field of Search ..... 141/369, 371, 372, 373, 141/374, 378, 312, 250, 275, 277, 278

[56] References Cited

U.S. PATENT DOCUMENTS

| | | | |
|---|---|---|---|
| 1,730,381 | 10/1929 | Pennock | 141/371 |
| 4,126,163 | 11/1978 | Hartness et al. | 141/371 |
| 4,616,684 | 10/1986 | Tincati | 141/372 |
| 4,721,138 | 1/1988 | Simonazzi | 141/372 |

FOREIGN PATENT DOCUMENTS

| | | |
|---|---|---|
| 8709382 | 8/1987 | Fed. Rep. of Germany . |
| 3621976 | 1/1988 | Fed. Rep. of Germany . |
| 8715816 | 1/1988 | Fed. Rep. of Germany . |
| 3713013 | 10/1988 | Fed. Rep. of Germany . |

*Primary Examiner*—Henry J. Recla
*Assistant Examiner*—Steven O. Douglas
*Attorney, Agent, or Firm*—Finnegan, Henderson, Farabow, Garrett & Dunner

[57] ABSTRACT

A vessel treating machine comprising at least one treatment element for treating bottles having a collar in the area below its opening and a device for holding the bottle for treatment by the treatment element independently of the treatment element, the device comprising a supporting element for supporting the bottle from its collar and a centering element being distance-variable relative to the collar so that a bottle to be treated can be clamped between its collar and its opening and centered axially relative to the treatment element.

19 Claims, 3 Drawing Sheets

VESSEL TREATING MACHINE

BACKGROUND OF THE INVENTION

This invention relates to a vessel treating machine of the revolving type.

Thin walled and unstable vessels, in particular plastic bottles, have been provided for quite some time with a stable collar in the area below the opening for reliable handling. Due to this, an especially designed carrying element can engage the vessels at the collar and lift them to the treatment element or station of a vessel treating machine. Due to this handling ability, the formerly customary lifting cylinder acting on the bottoms of the vessels can be eliminated.

So far, a plate with a U-shaped recess for the introduction and removal of the vessels from the treatment stations has been used as the carrying or supporting element in the most simple case. An exact centering of the vessel's opening with respect to a treatment element is not ensured, however, with such supporting elements, since, during the period of time from the pushing in of the vessel into the laterally open recess of the supporting element until the lifting and pressing of the vessel's opening against a seal at the filling element, the vessel does not exactly maintain its original position due to centrifugal forces occurring in rotary machines and also due to machine vibrations.

However, it is important that there be an exact centering of the vessel's opening, not only in the case of vessel inspection machines, but also filling valves with sensitive sensors. Especially in the case of inspection machines it is often required that the vessel not be pressed against a sealing surface attached to the treatment element, like e.g. in filling valves, but the vessel must be positioned in an open condition, i.e. not closed air-tightly, at an inspection probe. In special cases, an exact vertical positioning of the vessel opening is of importance during the inspection process. All these requirements cannot be satisfactorily fulfilled by the known devices.

As opposed to this, the invention is based on the object of bringing about an improvement as regards a safe and fast handling with a simultaneously high centering accuracy.

SUMMARY OF THE INVENTION

This object is attained in accordance with the present invention by providing in a vessel treating machine of the revolving type having at least one treatment element for treating a vessel on a revolving portion of the machine, the vessel having an upwardly directed opening with a collar below the opening, the improvement comprising a device for holding the vessel for treatment by the treatment element independently of said treatment element, said holding device comprising a supporting element for supporting the vessel from its collar, means for moving the supporting element and the treatment element relative to each other in the axial direction of the vessel for treatment of the vessel by the treatment element, a centering element located between the treatment element and supporting element, and means for moving the centering element and the supporting element relative to each other in the axial direction of the vessel and independently of the treatment element to engage the opening of the vessel with the centering element to center the vessel axially relative to the axis of the treatment element and to clamp the vessel between said centering element and supporting element by its opening and collar, respectively, for treatment of the vessel by the treatment element.

A vessel fed to the supporting element of the machine can be clamped by a relative movement in axial direction between the provided centering element and the supporting element supporting the collar by the indicated device. During this clamping process an exact centering of the vessel opening with respect to the treatment element is effected at the same time. For this purpose, the centering element is provided with a correspondingly formed centering surface on its side facing the vessel opening. The clamping and centering process can either take place by lowering the centering element to the vessel opening or by lifting the supporting element in the direction towards the centering element. Subsequently, the treatment element can be introduced into the vessel opening or, vice versa, the vessel can be moved in the direction towards the treatment element by means of a joint lifting of the centering and supporting elements.

During the treatment process, both the centering position and the level of the vessel opening with respect to the treatment element are kept immovable by means of the device according to the invention. To compensate for inevitable production tolerances during the production of the vessels it is especially advantageous if the centering and supporting elements are pressed against each other via a resilient element for vessel clamping.

According to a development of the invention it is especially advantageous if the required relative movements between the centering and supporting elements, on the one hand, and the vessel opening and the treatment element, on the other hand, can be carried out by a single control means. Due to this, the expenditures for control and the wear resulting during operation can be reduced to a minimum.

This can be implemented especially advantageously in a an arrangement of the vessel treatment element at a fixed height and an exclusive movement of the vessel.

The device according to the invention for handling vessels with collar can be also be used for filling machines for the gas-tight sealing of vessels with respect to a filling element in adapted form by using a sealing in the area of the centering element, the operating pressure of which deviates from atmospheric pressure during the filling process.

BRIEF DESCRIPTION OF THE DRAWINGS

An embodiment of the invention is explained in the drawings of which.

DETAILED DESCRIPTION OF THE INVENTION

Figure 1:
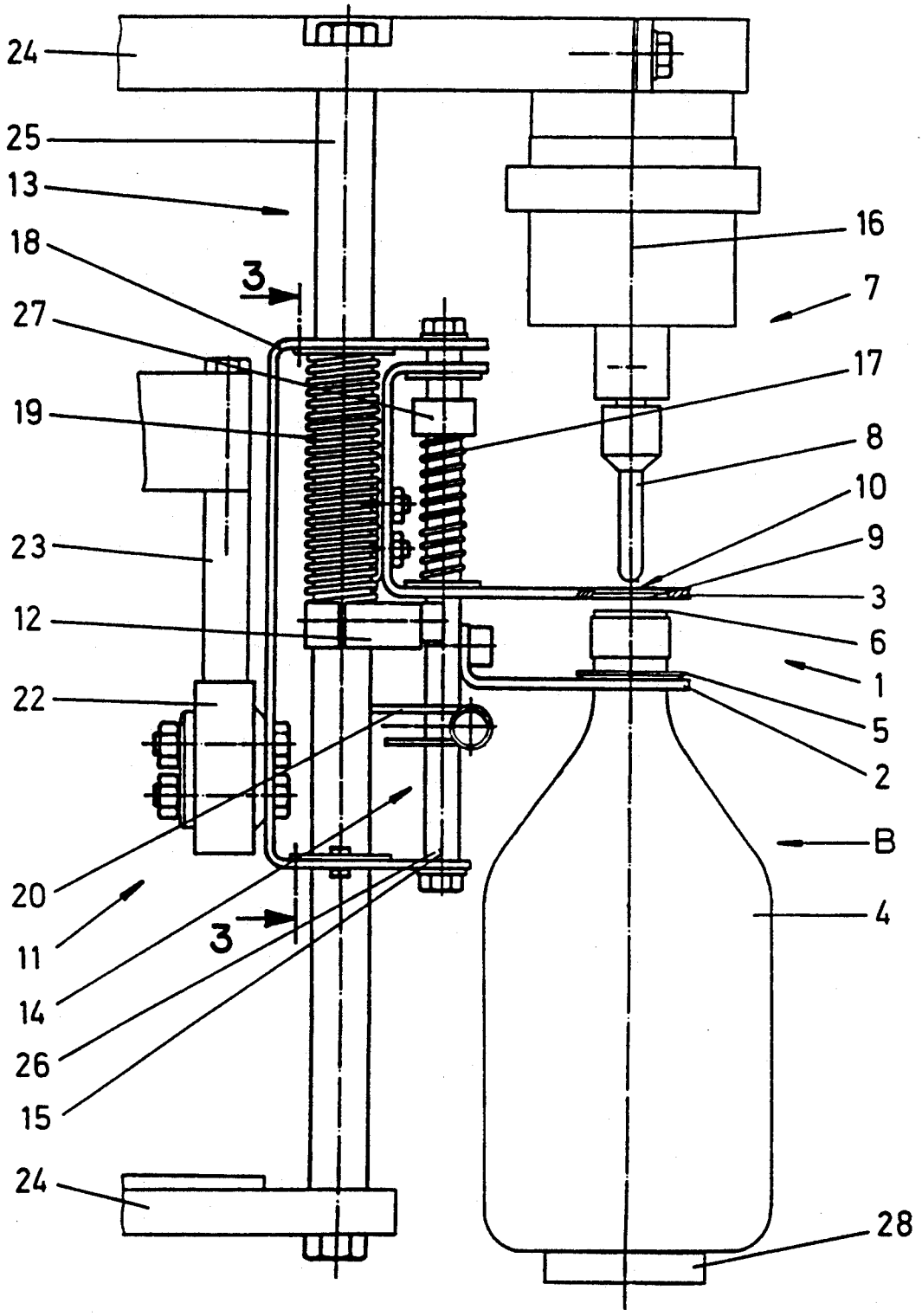
FIG. 1 is a side view of the device of the invention.
Figure 2:
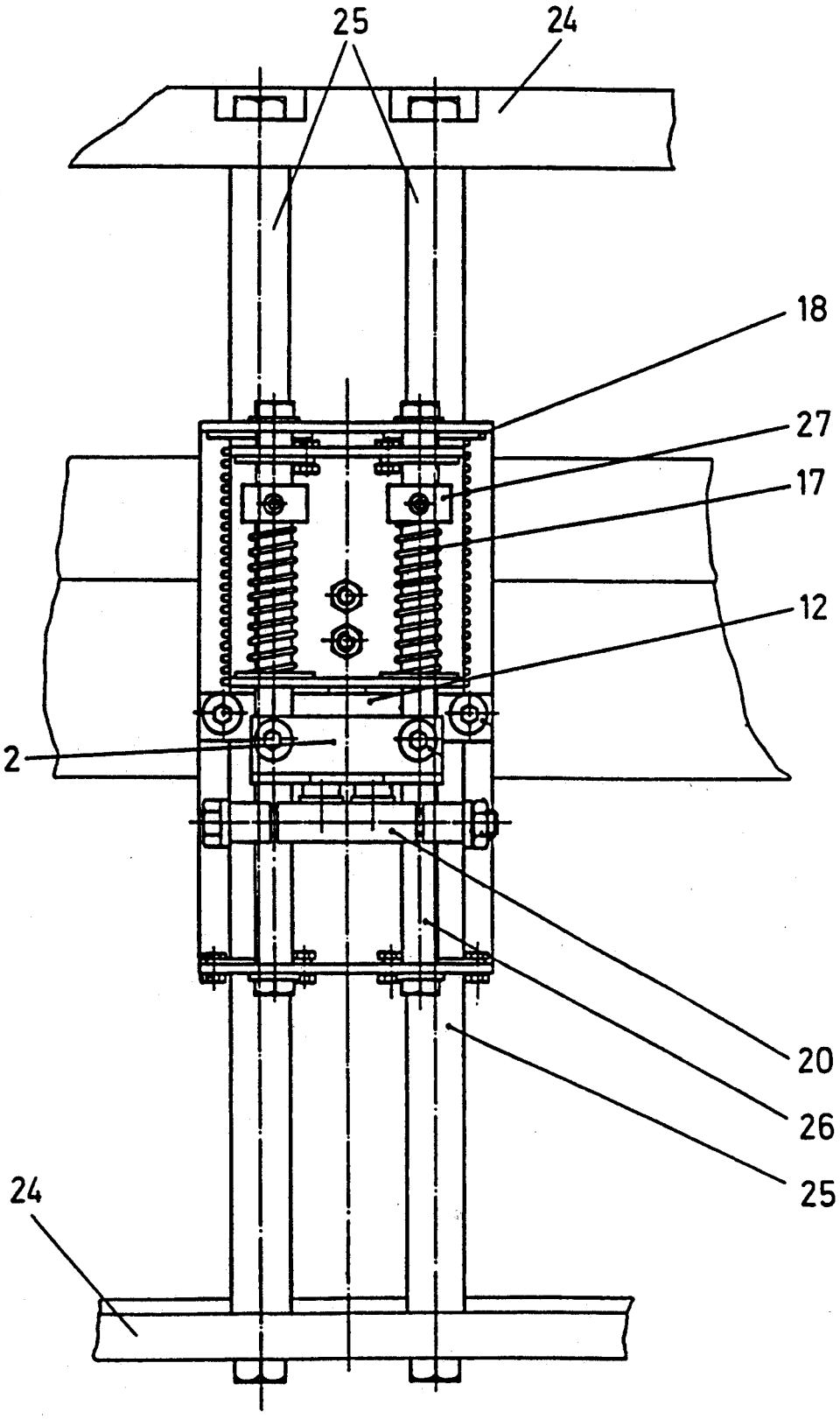
FIG. 2 is a front view of the device shown in FIG. 1 as seen in the direction of arrow B, with the vessel and treatment element removed.

An inspection device for returnable plastic bottles is shown in FIG. 1. The device comprises a treatment element 7 having a probe 8 for detecting any residues in the interior of vessels, which is rigidly affixed to the revolving part of a vessel treating machine designed like a carousel. An optional number of such treatment elements 7 may be disposed in side-by-side relationship on a common partial circle. The revolving part of the inspection machine, which is only partly outlined and designed in the style of a carousel, consists in its radially outer portion substantially of two spaced parallel supporting plates 24, between which two guide rods 25 of annular cross-section, which are in parallel to each other, are rigidly disposed in each case per treatment element 7. They form a guide 13 for a carriage 18 formed from a sheet bent in U-shaped fashion, which is mounted vertically displaceably along the guide 13 by means of slide bushings. A control means 11 is provided for controlling movement of carriage 18. As embodied, the control means comprises a cam roller 22 supported on the side of carriage 18 directed towards the machine's center, which cooperates with a control cam 23 disposed in the area between the vessel discharge and feeding stations of the machine. The control cam 23 exists as a cam segment only in a restricted revolving area of the machine. The cam roller 22 does not rest against any control cam in the remaining revolving area of the machine.

Two rods 26 being parallel to each other are disposed on the radially outer side between the two legs of the U-shaped carriage 18, which follow the vertical movement of the carriage 18 and form a guide 14 for a centering element 3. The centering element 3 is also designed as a U-shaped plate with slide bushings, the lower leg of the plate extending radially outwardly beyond the probe 8 of the treatment element 7. A circular opening 10 is provided concentric to the longitudinal axis 16 of the probe 8 in this leg. The side of opening 10 facing the vessel 4 is shaped as a centering surface 9, which is adapted to the shape of the opening 6 of the vessel. A U-shaped supporting element 2 designed as an angle plate and adapted to support a vessel from its neck collar 5 is rigidly screwed to the two rods 26 at a distance below the centering element 3.

A stop 20 which is vertically adjustable along the rods 26 is moreover fastened below the supporting element 2 in clampable fashion to the same, which defines the operating position of the centering element 3 and of the supporting element 2 in cooperation with a stop body 12 fastened to the guide rods 25. The stop body 12 is designed in bipartite fashion and can be clamped vertically adjustably to the guide rods 25 by means of clamping screws.

A spring-elastic element 19, which as shown, are coil springs surrounding the guide rods 25 acts continuously on the carriage 18 to bias it in the direction towards the treatment element 7, the element acting between the upper side of the stop body 12, which is fixed as regards its height, and the upper leg of the carriage 18.

In the same fashion, centering element 3 is continually acted upon by a spring-elastic element 17 to bias it in the opposite direction towards the supporting element 2. This is also carried out by means of two coil springs which are disposed in each case on one of the two rods 26 in the area between the legs of the centering element 3. The springs 17 are supported with one end on the lower leg of the centering element 3 and with their opposite end on a set collar 27 fastened to the rod 26.

Figure 3:
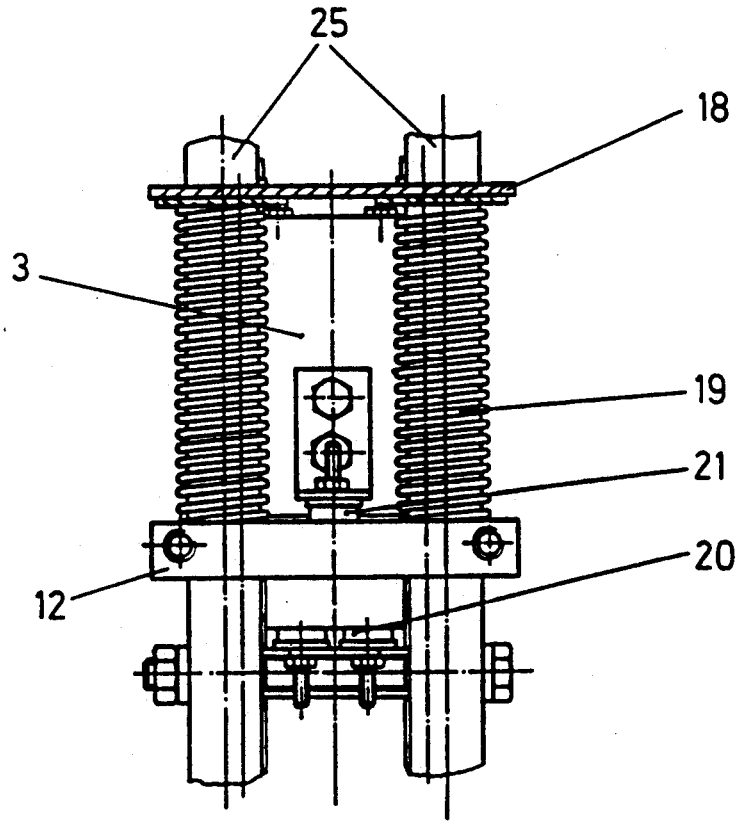
FIG. 3 is a partial sectional view taken along the line 3—3 in FIG. 1.

As can be recognized especially well in FIG. 3, the centering element 3 has an adjustable stop element 21 in the area between the two guide rods 25, which defines jointly with the upper side of the stop body 12 fixed as regards its height the ready position of the centering element 3 in the area between vessel discharge and feeding means.

A complete treatment cycle takes place as follows: The device adopts the position represented in FIG. 1 in the feeding means of the machine. The vessels 4 to be introduced into the machine slide on stationarily disposed guide plates (not shown) with their collars 5. in alignment with that of a supporting element 2. By means of a feeding star driven synchronously to the machine and engaging the vessel body, a vessel is introduced into the U-shaped recess of the supporting element 2 from the said guide plates and rests with its collar 5 on the upper side of the supporting element 2. The vertical position of the supporting element 2 in this so-called ready position is determined by the contour of the control cam 23 which comes into play in this position, cam roller 22 being held in pressed fashion against cam 23 by the spring-elastic element 19. At the same instance, the lower side of centering element 3 is only a few millimetres above the opening 6 of the vessel 4 this position being determined by the stop element 21 fastened to the centering element 3, which can be seen in FIG. 3, and the upper side of the stop body 12. The contour of the control cam 23 is designed in such a fashion that during the further revolution of the machine, the cam roller 22, the carriage 18 and the supporting element 2 being fastened thereto can move upwardly under the spring force of the element 19 until shortly thereafter the opening 6 enters into the opening 10 of the centering element 3, the vessel being centered at the same time under the influence of the centering surface 9. The result of this is that, during the further movement, the centering element 3, and thus the stop element 21 are lifted from the stop body 12 in the direction towards the probe 7 until the stop 20 comes to rest against the lower side of the stop body 12, whereby the upward movement of the carriage and all elements attached thereto is stopped.

The control cam 23 ends at this point. Due to the dynamic effect of the spring element 17, the vessel 4 to be inspected is clamped between elements 2 and 3 by its collar 5 and opening 6 in form-fit fashion. The necessary inspection processes are then carried out in this operating position.

Prior to the reaching of the vessel discharge, the cam roller 22 runs onto the control cam 23 which begins there, so that the carriage 18 and thus the vessel 4 is lowered downwardly under the influence of spring element 19. As soon as the stop element 21 of the centering element 3 contacts the stop body 12 an its upper side, the downward movement of the centering element 3 is terminated, while the carriage 18 together with the supporting element 2 continues to slide downwardly. This causes an enlargement of the distance between the centering element 3 and the supporting element 2, whereby the opening 6 of the vessel 4 is released from element 3. The downward movement of the vessel is stopped when the bottom of the vessel impacts on a transfer plate 28. The contour of the control cam 23 can be designed in such fashion that the supporting element 2 still continues to move slightly downwardly with respect to the collar 5 so as to thereby completely release the vessel 4. At the same time, the vessel 4 is gripped at the body portion by a discharge star (not shown) and guided onto a discharge conveyor. Thereafter, the device 1 reaches again the feeding star, whereby the described working cycle starts again in the same fashion.

I claim:

1. In a vessel treating machine of the revolving type having at least one treatment element for treating a vessel on a revolving portion of the machine, the vessel having an upwardly directed opening with a collar below the opening and the treatment element having a terminal end required to be centered with respect to the opening of the vessel, the improvement comprising a device for holding the vessel for treatment by the treatment element independently of said treatment element, said holding device comprising a supporting element for supporting the vessel from its collar, means for moving the supporting element and the treatment element relative to each other in the axial direction of the vessel for treatment of the vessel by the treatment element, a centering element located between the terminal end of the treatment element and supporting element, and means for moving the centering element and the supporting element relative to each other in the axial direction of the vessel and independently of the treatment element to engage the opening of the vessel with the centering element to center the vessel axially relative to the axis of the treatment element and to clamp the vessel between said centering and supporting elements by its opening and collar, respectively, for treatment of the vessel by the treatment element.

2. The vessel treating machine of claim 1, wherein the holding device is mounted for axial movement relative to the treatment element.

3. The vessel treating machine of claim 1, wherein the centering element has an opening with a centering surface facing the vessel adapted to the contour of said vessel opening.

4. The vessel of claim 3, wherein the opening in the centering element is concentrically aligned with the treatment element.

5. The vessel treating machine of claims 1, 2, 3 or 4, wherein the supporting element comprises a plate-shaped part having a substantially U-shaped recess therein open towards one side to receive the vessel below its collar.

6. The vessel treating machine of claim 1, wherein the treatment element is fixedly mounted and the supporting element and the centering element are displaceable in an axial direction relative to the treatment element.

7. The vessel treating machine of claim 6, wherein the means for moving the supporting element relative to the treatment element and the means for moving the centering element and the supporting element relative to each other are controlled by a single control means.

8. The vessel treating machine of claim 7, wherein a stop body on the revolving portion of the machine fixed relative to the treatment element defines the position of the centering element and the supporting element when the vessel is clamped by said elements.

9. The vessel treating machine of claim 8, wherein the supporting element is moved towards the centering element to engage the opening of the vessel with the centering element and the stop body defines the position of the centering element before the vessel is brought into engagement with it.

10. The vessel treating machine of claim 6, wherein the supporting element is rigidly connected to a guide on the holding device, said guide extending parallel to the axis of the treatment element, the centering element being displaceably mounted on said guide.

11. The vessel treating machine of claim 10, wherein the centering element is biased in a direction towards the supporting element by a spring means.

12. The vessel treating machine of claim 11, wherein the guide is rigidly disposed on a carriage displaceably guided in parallel to the axis of the treatment element on the revolving portion of the machine.

13. The vessel treating machine of claim 12, wherein the carriage is biased in a direction towards the treatment element by a spring means.

14. The vessel treating machine of claim 13, wherein the stop body in connection with a cooperating stop mounted on the carriage limits the travel of the carriage in the direction towards the treatment element.

15. The vessel treating machine of claim 14, wherein the stop body and the cooperating stop are adjustable relative to each other.

16. The vessel treating machine of claim 13, wherein a stop element on the centering element in combination with the stop body limits movement of the centering element away from the treatment element.

17. The vessel treating machine of claim 13, wherein the control means comprise a cam roller mounted on the carriage which cooperates with a control cam surface that is stationary with respect to the revolving portion of the vessel treating machine.

18. The vessel treating machine of claim 17, wherein the control cam surface is a cam segment extending in the area between a vessel discharge and feeding position of the machine.

19. The vessel treating machine of claim 17, wherein the lower end position of the supporting element is defined by the control cam.

* * * * *